US006793569B2

(12) United States Patent
Lundum

(10) Patent No.: US 6,793,569 B2
(45) Date of Patent: Sep. 21, 2004

(54) SANDING STRIP

(76) Inventor: Poul Lundum, Toftegaardsvej 20, DK-8370 Hadsten (DK)

( * ) Notice: Subject to any disclaimer, the term of this patent is extended or adjusted under 35 U.S.C. 154(b) by 0 days.

(21) Appl. No.: 10/257,482

(22) PCT Filed: Apr. 10, 2001

(86) PCT No.: PCT/DK01/00254

§ 371 (c)(1),
(2), (4) Date: Oct. 10, 2002

(87) PCT Pub. No.: WO01/76824

PCT Pub. Date: Oct. 18, 2001

(65) Prior Publication Data

US 2003/0092370 A1 May 15, 2003

(30) Foreign Application Priority Data

Apr. 10, 2000 (DK) ..... 2000 00598

(51) Int. Cl.[7] ..... B24B 9/02
(52) U.S. Cl. ..... 451/490; 451/464; 51/330
(58) Field of Search ..... 451/464, 466, 451/469, 490; 51/330, 331, 332, 334

(56) References Cited

U.S. PATENT DOCUMENTS

| | | | | | |
|---|---|---|---|---|---|
| 3,139,641 | A | * | 7/1964 | Grogan et al. | 15/182 |
| 3,747,285 | A | * | 7/1973 | Block | 451/469 |
| 4,183,183 | A | * | 1/1980 | Belanger | 451/469 |
| 4,217,737 | A | * | 8/1980 | Hasegawa | 451/469 |
| 4,251,958 | A | * | 2/1981 | Langenberg et al. | 451/467 |
| 4,882,879 | A | * | 11/1989 | Warner et al. | 451/469 |
| 4,969,299 | A | * | 11/1990 | Block | 451/463 |
| 6,217,124 | B1 | * | 4/2001 | Jespersen | 300/21 |
| 6,217,431 | B1 | * | 4/2001 | Brinkmann | 451/464 |

* cited by examiner

*Primary Examiner*—Joseph J. Hail, III
*Assistant Examiner*—Anthony Ojini
(74) *Attorney, Agent, or Firm*—Cantor Colburn LLP

(57) ABSTRACT

A sanding strip with a sanding means for a sanding wheel mounted on a rotatable axle is provided. The sanding strip includes brushes placed in spaced brunches in a profile rail, where the sanding means are fastened directly to the front of the brushes outside the profile rail, preferably by means of extended glue which penetrates into the spaces between the brush bunches, whereby there is achieved an effective anchoring of the sanding means, and a sanding strip which is flexible to accommodate outwards bending in the sideways directions.

10 Claims, 7 Drawing Sheets

SANDING STRIP

BACKGROUND OF INVENTION

1. Field of Invention

The present invention concerns a sanding strip with a sanding means for a sanding wheel for mounting on a rotatable axle, where the sanding wheel comprises a core comprising undercut grooves in which the sanding strip is anchored by edge rails co-operating herewith, and in which there are secured line-formed bracing elements which extend radially from the core, preferably in the form of line-formed brushes, at least the one side surface of which supports the sanding means, the free ends of which extend outside the free ends of the brushes.

2. Description of Related Art

Such sanding wheels are used, for example, within the woodworking and furniture industries for the surface treatment/sanding of plane surfaces for producing smooth surfaces. Since the sanding means normally used in connection with sanding wheels is very flexible as a consequence of their small thickness, the function of the bracing elements/the brushes is to ensure a certain application pressure between the sanding means and the items which are to be sanded.

The bracing elements, in the following referred to as the brushes, thus have no actual cleaning effect in the form of a removal of sanding dust from the sanded surface during rotation of the sanding wheel. The sanding dust is removed by suction applied over the sanding area and, moreover, by subsequent processing of the sanded items.

The sanding wheels are produced in variable breadths and with variable diameters, and are mounted on rotatable axles on sanding machines which are arranged for this purpose. An example of this can be a sanding machine comprising a table with a feed unit for the feeding forward of the items, which are surface treated during their passage of the axles with the sanding brushes. The sanding machines may well comprise up to several successively arranged rollers with sanding brushes, each provided with sanding material of different roughness. Out of regard for the processing of the edges of the items, the sanding rollers can be inclined in relation to the transport direction of the items, in that this results in a slight chamfering (moulding) of the side edges of the sanded items. Moreover, the inclined position of the rollers results in the constant removal of the sanding dust from the sanded surface. The said inclined position of the rollers in a sanding machine constitutes a considerable contribution towards the increase at the costs involved in the manufacture of a sanding machine, in that the inclined suspension of the rollers in relation to the transport direction of the items requires special bearings and drives for the axles on which the sanding wheels are mounted.

From DK 171364 there is known a sanding wheel where the sanding strips are secured to a cylindrical core for mounting on a rotatable, driven axle. The sanding strips are secured extending in a radial manner from the cylindrical core, and the sanding strips are secured in undercut grooves which extend parallel in the periphery of the core for accommodation of sanding strips arranged for this purpose, where the brushes are enclosed within a U-shaped nylon or aluminium rail, the external profile of which has a cross-section which co-operates with the cross-section of the undercut grooves. At the end of the core, the grooves are blocked by the edges of covers mounted on the ends of the core, whereby the sanding strips are held in position in the state of use, and the sanding strips can be replaced without having to dismount the core, in that only the one end cover is removed and the sanding strips to be replaced are drawn out of the undercut grooves at the and of the core, and new sanding strips are mounted.

It is important to note that the sanding strips which are used and disclosed in DK 171 364 are relatively stiff in the axial direction, in that they comprise brushes with brush hair which is firmly anchored in a profile of stiff material such as a U-shaped strip steel profile, the free ends of which are clamped together around the one end of the brush hairs. It should be noted that by this known technique the sanding means are secured to the sanding strips with an aluminium clamping rail. This is firmly clamped so that the sanding means are secured between the external side of the brush rail and the clamping rail. With this construction, it is achieved that it is not necessary to replace/discard the core each time the sanding strips need to be changed. However, the actual construction of the sanding strips is inexpedient, in that the sanding means are secured to the brush with said clamping rail, the result being that this type of sanding strip is very stiff in its axial direction.

In DK 171 364, however, other solutions are disclosed for the securing of the sanding means for the sanding strips, for example by placing the sanding means between the walls in the undercut grooves and the outer side of the clamping rail which co-operates with the groove, whereby the axial stiffness of the sanding strip is reduced in comparison with the above-mentioned embodiment where use is made of two clamping rails.

However, it is common to all known sanding strips with brushes that they involve line-formed brushes which, with or without an edge wire, are secured between the clamped-together webs of a U-shaped clamping rail, the result being that the sanding strip has an axial stiffness which makes it unsuitable for absorbing deviations in the axial direction. It must be noted that when there is mention here of deviations in the axial direction, this is to be understood as axial deviations of the clamping rail in relation to a straight extent.

In DK 172548 B1 there is disclosed a method for the manufacture of a flexible sanding element where both the brush hair and the sanding means are secured in a flexible U-shaped plastic profile, in the cavity of which the one side of the sanding means are placed together with supporting brush hair and heat-fusible plastic wire, where by heating above the melting temperature of the plastic there occurs a bedding-in of the brushes and the sanding strips, so that they form an integral unit which ensures that brushes and/or sanding means are not released during use of rotating sanding or polishing tools of which the sanding elements form part.

There is hereby achieved a flexible sanding element which is able to absorb deviations in the axial direction. However, the method concerning the manufacture of this type of sanding strip in not expedient, in that this requires the placing of both brush hair and the side edge of the sanding means in the U-shaped profile together with a heat-fusible plastic wire, and it requires a heating of the plastic wire after the brush hair and the sanding means have been placed in the cavity of the U-shaped profile.

SUMMARY OF INVENTION

The invention provides a flexible sanding strip for use on sanding wheels having undercut grooves for securing the sanding strip at peripheral areas thereof, where use is not made of clamping rails for securing the sanding means on the sanding strip, and which can be produced in a simple manner. Furthermore, the invention provides a method for the manufacture of sanding strips in endless webs, from which suitable lengths can be cut for mounting on the periphery of a sanding wheel with undercut grooves.

According to one aspect of the invention, a sanding strip comprises a flexible brush profile rail with an external profile for accommodation in undercut grooves in the external periphery of a cylindrical core, and where the brush hair which forms the line-formed brush is placed and secured in bunches in the respective holes in an in-line row of holes in the longitudinal direction of the brush profile rail, and in such a manner that along the brush profile rail a space is formed between the individual brush hair bunches in the longitudinal direction of the brush profile rail, which is characterized in that the sanding means are secured directly to at least one side of the brushes outside the brush profile rail, preferably by gluing.

By the securing of the sanding means directly on the brushes, the use of the clamping rail for the securing of the sanding means on the side of the brush rail is rendered superfluous, or alternatively the placing of the sanding means clamped in between the walls of the undercut grooves and the herewith co-operating external profile of the clamping rail, and hereby the working operations connected herewith.

It is decisive whether the sanding means can be adhered/secured in an adequate manner directly on the sides of the in-line placed bunches of brush hair that a small distance exists between each individual bunch of brush hairs. This space is filled out with glue along the gluing breadth, so that the glue flows in between the individual hair bunches to the rear edge of the row of holes on the side opposite to that on which the glue is applied, on which after application of the glue the sanding means are placed with the one side edge extending parallel with the narrowest side edge of the PE brush rail. With the hardening of the glue, there thus arises a form of locking/anchoring of the sanding means by the hardened glue mass which constitutes an element which, in the gluing area, substantially surrounds and adheres to the individual brush bunches. Moreover, the sanding means are naturally also adhered to the outermost brush hair of the individual brush bunches in the in-line row of brushes. It must be emphasized, however, that the gluing in between the outermost brush hairs and the sanding means will not be sufficient in itself to secure the sanding means on the sanding strips during use. The sanding means will simply become loose and flake off after a relatively short period of use, simply because the outermost brushes will break due to the mechanical load which consists of both axial traction and transverse loading in the outermost layer of brush hair when the sanding strips on the rotating sanding wheel are brought into contact with the item to be sanded/polished.

Moreover, with the use of a PE brush profile rail which co-operates with the undercut grooves in the external periphery of the cylindrical core, it becomes possible to be able to effect a replacement of individual sanding strips on the sanding wheel in the same way as with the known sanding wheels. Here, for example, every alternate sanding strip could be replaced at regular intervals with the object of achieving a uniform surface on the items processed by the sanding wheels.

Without renouncing other methods of securing, it an be mentioned that a preferred securing method consists of gluing directly on the brushes.

Moreover, without renouncing the use of other types of glue, it can be mentioned that a preferred glue for the securing of the sanding means to the side of the brushes consists of hot-melt glue.

A second preferred method for the securing of the sanding means directly on the brushes can consist of sewing, where the sanding means are sewn onto the brushes in an area in the immediate vicinity of the brush rail.

An additional preferred method for the securing of the sanding means directly on the brushes can be exercised by means of double-sided adhesive tape, which is applied to the brushes in an area in the immediate vicinity of the brush rail.

It must be mentioned that the flexible brush profile rail can with advantage consist of a flexible PE, whereby it is achieved that the line-formed brush becomes pliable in the axial direction.

It must be mentioned that the undercut grooves in the cylindrical core, and the PE profile rails co-operating herewith, can with advantage have a dove-tailed cross-section.

The advantage herewith is that with rotation of the core/sanding wheel, as a result of the centrifugal force the PE profile rail will be clamped together around the bracing elements (the brush hairs), which supports the sanding materials on the sanding brush.

It must further be mentioned that the bunches of brush hairs which are secured in the row of holes in the PE brush profile rail can with advantage be secured in the bottom of the holes by means of a U-shaped staple, the legs of which inserted in the PE profile rail are staggered in parallel and cross each other, so that the hairs in the brush bunch are anchored in their centre, with their free ends extending straight up over the PE profile rail on both sides of the staple. It must be mentioned that the brush hairs can also be secured in the PE profile rail by gluing.

The sanding strip according to the invention is able to be produced in a considerably easier manner than the hitherto-known sanding strips comprising clamping rails, in that the latter are necessarily produced individually in lengths determined beforehand.

With the sanding strip according to the invention, it will be possible to produce sanding strips in rolled-up webs, which at the place of use can subsequently be cut up into the lengths desired by the user, and inserted in the undercut grooves in the periphery of the core.

A method for the manufacture of a rolled-up web of sanding strip can be that from a supply of line-formed brushes provided with edge rails with a cross-sectional profile corresponding to a given undercut groove in the periphery of a sanding roller, supplied in a length by transport means, where there is extruded at least one string of a suitable hot-melt glue in a gluing area near the edge of the profile rail from which the brush hairs are extending, so that the glue penetrates into the spaces between the brush bunches in the longitudinal direction of the brush profile rail, after which via feeding means and pressure rollers a layer of sanding means from a supply is applied to the relevant brush side which is pressed against in the gluing area, after which the brush with the glued-on layer of sanding means is fed further for rolling-up, or alternatively is cut up into predetermined lengths.

With the sanding strip and the method for the manufacture of same, there can be envisaged a completely other type of sanding wheel, where the user purchases the sanding strips in rolls or by the metre, and thereafter cuts the sanding strips up into suitable lengths and carries out the work of mounting the sanding strips. The sanding strip according to the invention will thus be considerably easier to pack and despatch than sanding strips in long lengths.

The already discussed, known construction of the swallow-tail formed rail profile which firmly secures brushes and sanding means so that together they form a sanding strip, results in a relatively stiff rail profile with a relatively limited flexibility, but this type of sanding strip has found a certain widespread use as a result of the flexibility in the replacement of the individual sanding strips on the core, which can be effected, for example, so that each alternate sanding strip is replaced at a time, whereby a great uniformity is achieved in the surface processing of the surfaces treated by the sanding brush.

The presence of the relatively stiff clamping rail for securing the sanding means on the sanding strips makes it necessary, however, that the dove-tailed groove in the core must be straight and oriented in parallel with the central axis of the core, which means that the sanding rollers must be inclined in order to achieve the desired chamfering of the edges of the sanded item.

The sanding strips according to the present invention open the possibility of changing this situation, in that the securing of the sanding means directly on the brush sides by means of a suitable glue results in the sanding strip being able to absorb deviations in the axial direction, at the same time that this will essentially maintain the resilience and lateral pliancy which characterizes the brush and the PE brush profile rail, as opposed to the known sanding strips with dove-tail shaped edge rails with clamping rails for securing the sanding means.

With the invention, the possibility has thus been realized of being able to avoid the inexpedient inclined positioning of a sanding machine's sanding rollers of the disclosed kind, at the same time that an edge processing of the surface of the treated item is effected by configuring the undercut grooves in the periphery of the core so that these extend in a spiral or helical manner in relation to the axis of the core, and inserting the flexible sanding strips according to the invention into these grooves.

There is hereby achieved the same effect as if the sanding rollers were suspended in an inclined manner in relation to the transport direction of the items. Here, it is merely the sanding strip itself which is inclined in relation to the core, instead of the sanding strips being placed extending parallel with the centre axis of the core, and the central axis being inclined in relation to the transport direction of the items.

In practice, this means that by use of the sanding strips and the spirally-formed undercut grooves in the periphery of the core, it will be possible to dispense with the inclined positioning of the rollers which increases the construction costs involved in the building of new sanding machines, while at the same time a chamfer sanding of the edges of the items can be effected. Moreover, it will be possible for older sanding machines provided with sanding wheels according to the invention to be able to effect the desired sanding, where a chamfering of the edges of the sanded items is also achieved.

It must also be mentioned that it is preferred that the undercut grooves and the brush profile rails have a cooperating dove-tail shaped cross-section.

BRIEF DESCRIPTION OF THE DRAWINGS

In the following, the invention will be explained in more detail with reference to the drawing, where.

DETAILED DESCRIPTION OF PREFERRED EMBODIMENTS

Figure 1:
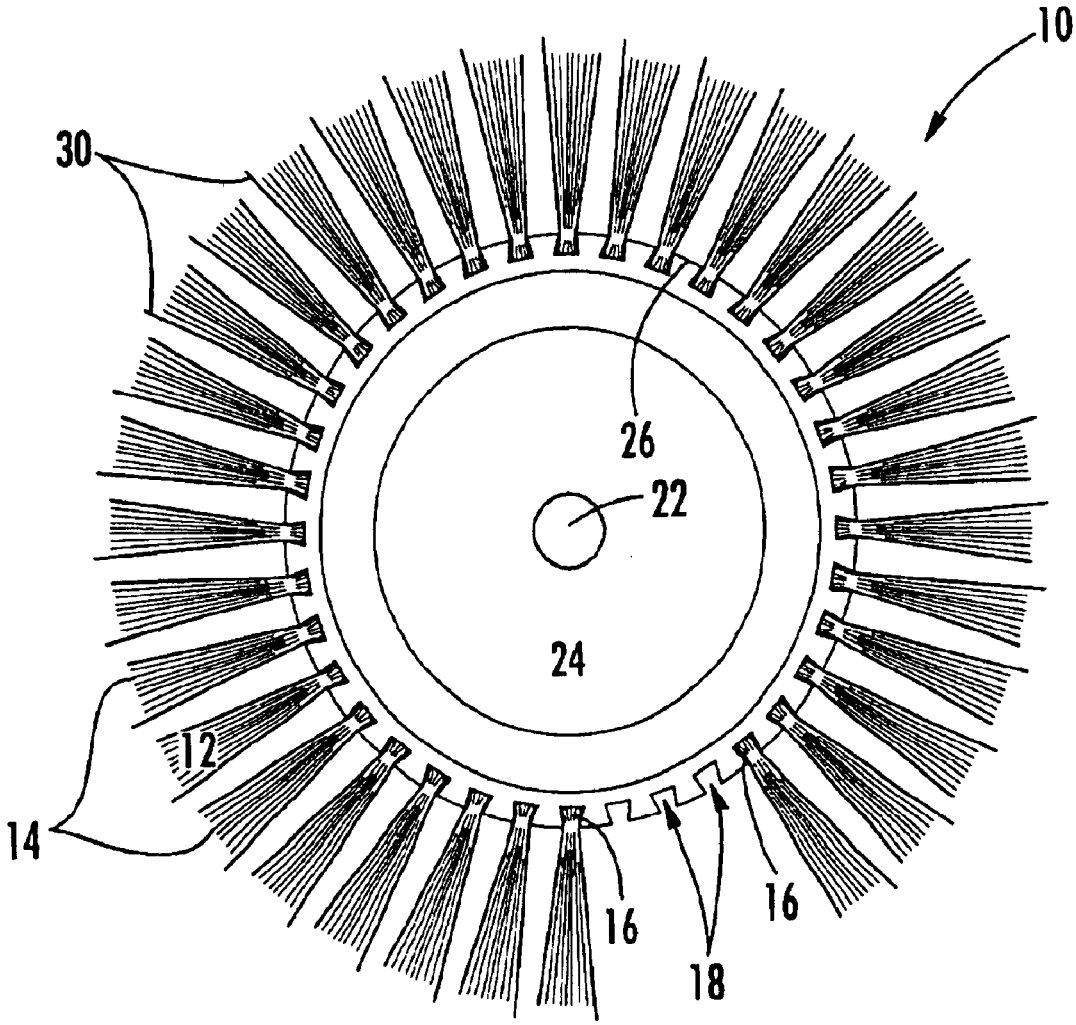
FIG. 1 shows a sanding brush according to the invention, with undercut grooves for the accommodation and securing of sanding strips, the edge rails of which have a profile co-operating with the undercut grooves.

FIG. 1 shows a plan view of a sanding wheel 10 comprising sanding strips 12 according to the invention. As will appear from the figure, the brushes 14 of sanding strips 12 are secured in a brush rail 16 which has a cross-section which fits in an undercut groove, in the shown embodiment a dovetail cross-section, which when the sanding strips are mounted is accommodated in grooves 18 co-operating herewith in the external periphery of a cylindrical core 20 with a circular cross-section, in that said grooves 18 are oriented parallel with the central axis 22 of the core, and extend for the whole length of the core. In its ends, the cylindrical core 20 has covers 24, the center of which are provided with through-going holes 24 for the accommodation of a not-shown drive shaft. The covers are provided with a recess, so that the edge of the cover extends parallel with the edge 26 of the core, and such that when the sanding wheel is mounted, the grooves 18 are blocked, so that the sanding 12 strips are secured in their positions, extending radially from the sanding wheel.

Figure 2:
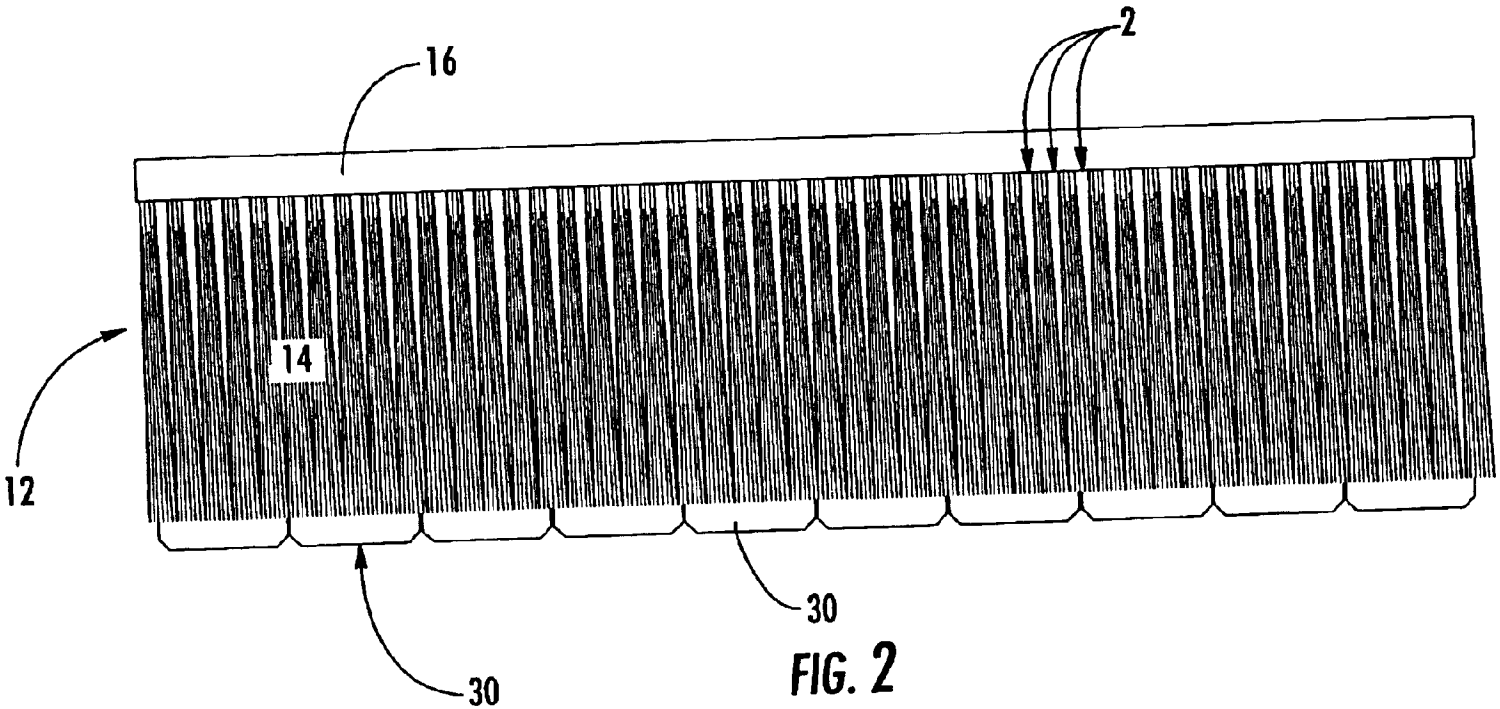
FIG. 2 is a side view of a sanding strip according to the invention with hair side upwards.

FIG. 2 shows a side view of a sanding strip 12 according to the present invention with hair side 28 upwards. As will be seen, the brush hairs 14 are secured in a groove in a U-shaped plastic rail 16, which as shown in FIG. 2 has a dove-tail shaped external cross-section. In the background is seen the rear of a sanding means 30 which is glued with hot-melt glue on the opposite side of the brushes 14. The sanding means 30 in the shown example embodiment consists of a length of segmented emery cloth with a back 33 of canvas and a front 31 to which a relevant sanding material is applied, cf. FIG. 3. The result of the segmenting is that the sanding strip becomes more flexible, in that the individual segments 34 can move independently.

Figure 3:
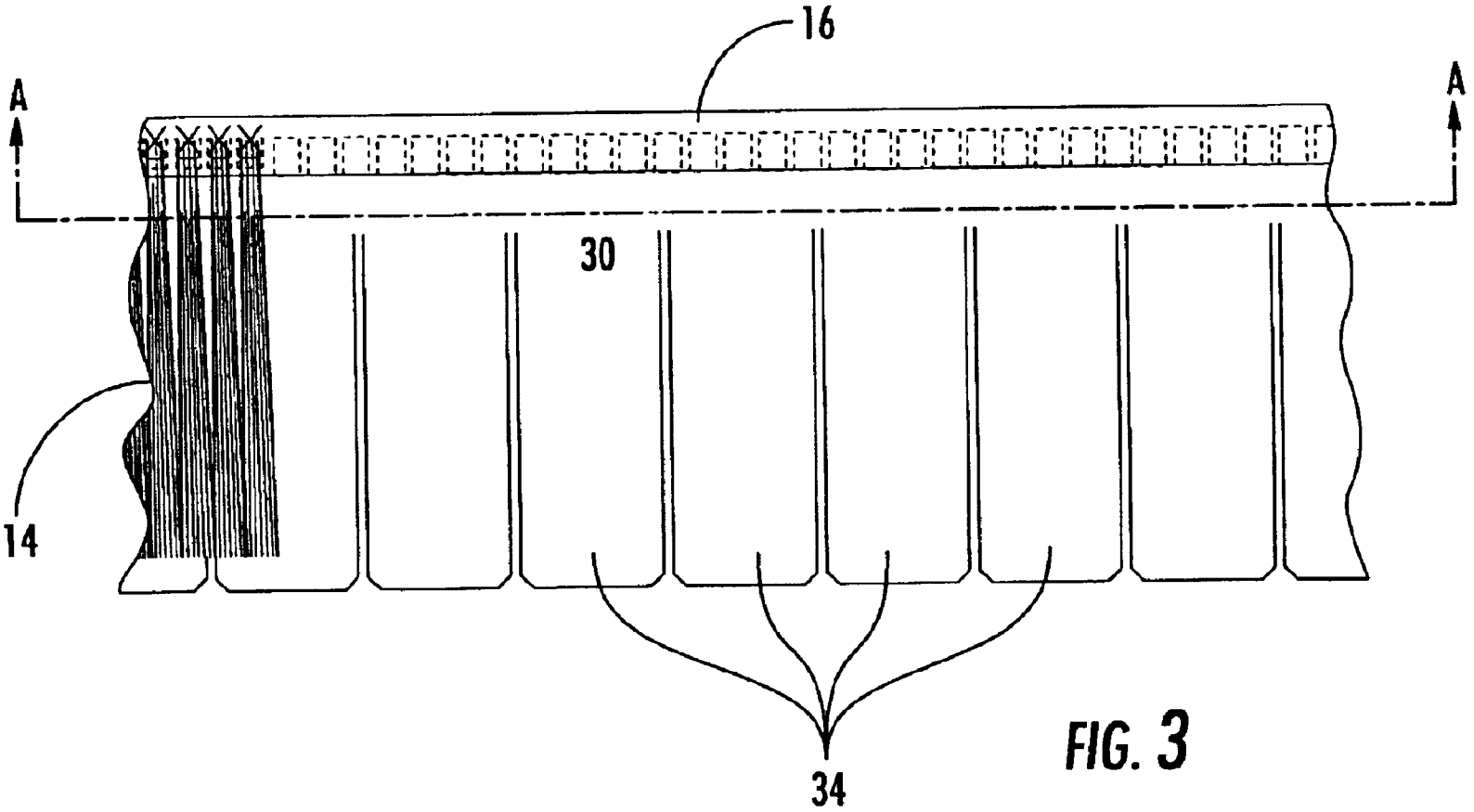
FIG. 3 is a side view of the sanding strip in FIG. 2 with the sanding means upwards.

As will appear from FIG. 3, the sanding means 30 is glued along the edge 4 of the brush rail 16, and no securing means are used other than the already-mentioned hot-melt glue.

Figure 4:
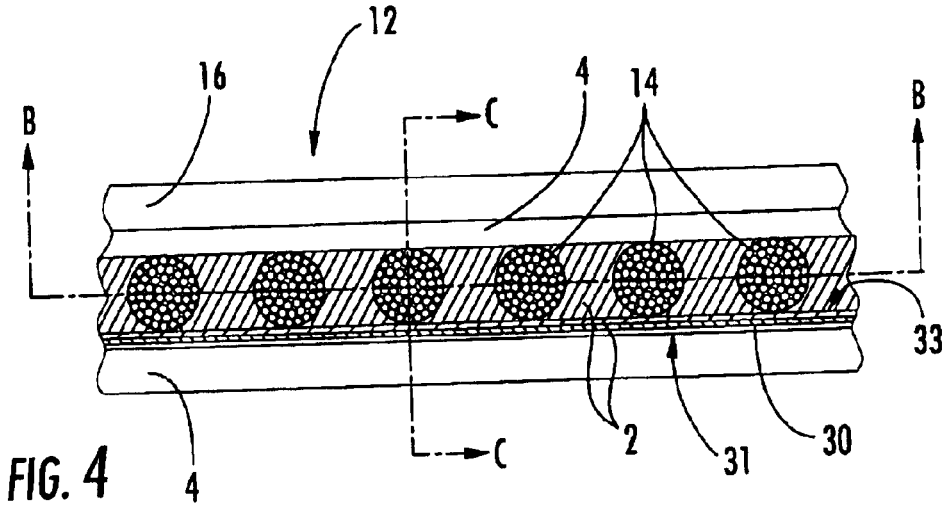
FIG. 4 shows a section through a sanding strip seen from above along the line A—A in FIG. 3.

In FIG. 4, which is a sectional view through the sanding strip according to the invention along the line A—A in FIG. 3, it is seen how hardened hot-melt glue 2 has adhered respectively to the canvas on the back 33 of the sanding means 30 and the sides of the bunch-formed brush hair 14, so that the glue mass substantially surrounds these and has adhered to their surfaces. The hardened mass of hot-melt glue 2, together with the bunches of brush hair 14 along the edge 4 of the PE rail 16 and the emery cloth 30, thus constitute an integrated mass, the extent of which in the longitudinal direction of the brush hairs is indicated in FIG. 6.

Figure 5:
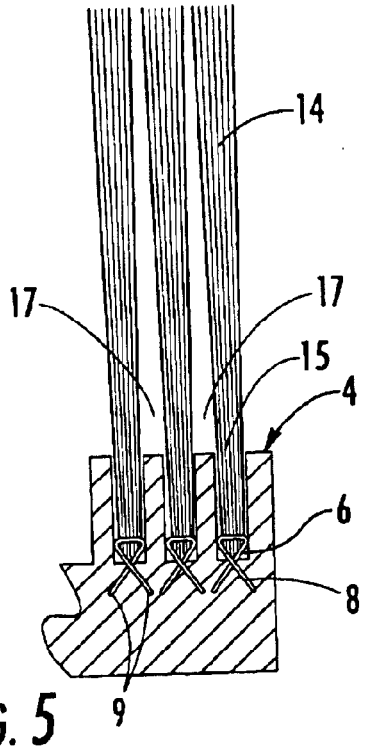
FIG. 5 shows a section seen from the side along the line B—B in FIG. 4.
Figure 6:
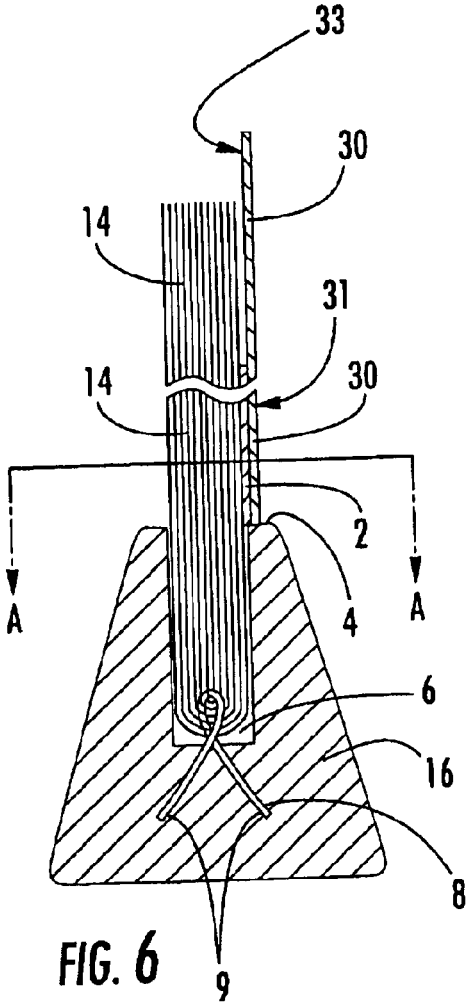
FIG. 6 shows a section along the line C—C in FIG. 4.

In FIG. 5, which is a longitudinal section along the line B—B in FIG. 4, it is shown how the line-formed brushes 14 of the sanding strip are placed in bunches 15 in holes 6 in the PE profile rail 16, and how the respective bunches 15 of brushes 14 are anchored in the bottom of the holes 6 by means of U-shaped staples 8, the legs 9 of which cross each other and are displaced in parallel as is shown in FIG. 6. Between the respective bunches 15 of brushes, in an area nearest to the PE profile rail 16, there is a space 17, and it is this space which is completely or partly filled out by the glue 2 which is used to secure the sanding means to the sanding strip, so that as shown in FIG. 4, the bunches 15 of brush hairs 14 are almost completely surrounded by hardened glue, which thus constitutes a coherent mass which adheres to the back of the sanding means 30, which typically comprises a strong canvas, so-called emery cloth.

Figure 7:
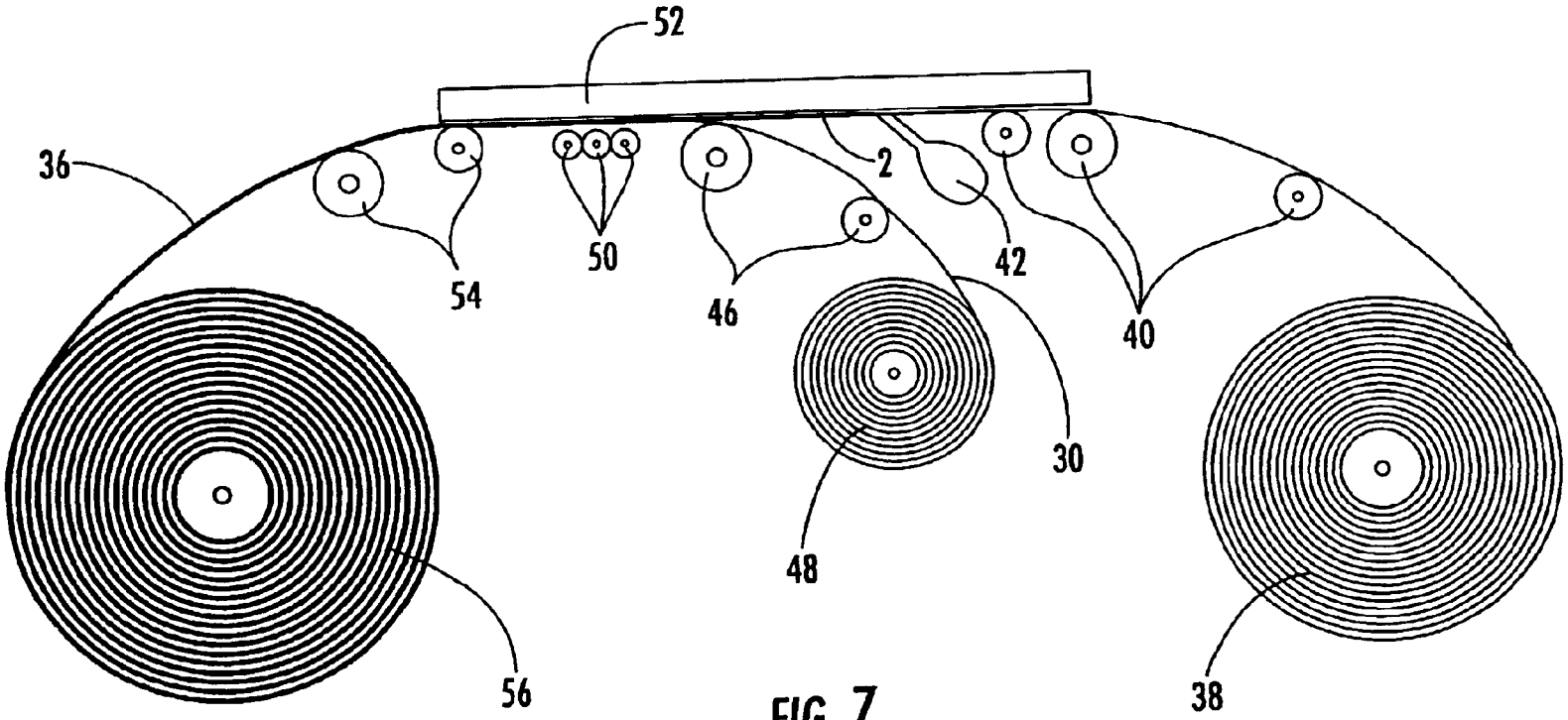
FIG. 7 shows the principle involved in the manufacture of sanding strips in endless webs according to the invention.

FIG. 7 shows the principle used in the procedure for the manufacture of a continuous web 36 of sanding strip.

The principle involves a rolled-up supply 38 of brushes in an edge rail 16 with an external dove-tailed profile, which by feed rollers 40 is fed past a glue extruder 42 for hot-melt glue 44, which is extruded in a string near the edge rail 16, after which via a second set of feed rollers 46 the glue is provided with a web of sanding means 30 from a supply 48, after which the sanding means 30 is pressed against the gluing area by a number of pressure rollers 50 and a plate 52. The continuous web of sanding means 36 is finally fed via a one or more feed rollers to a rolled-up supply 56 of finished sanding strip.

Figure 8:
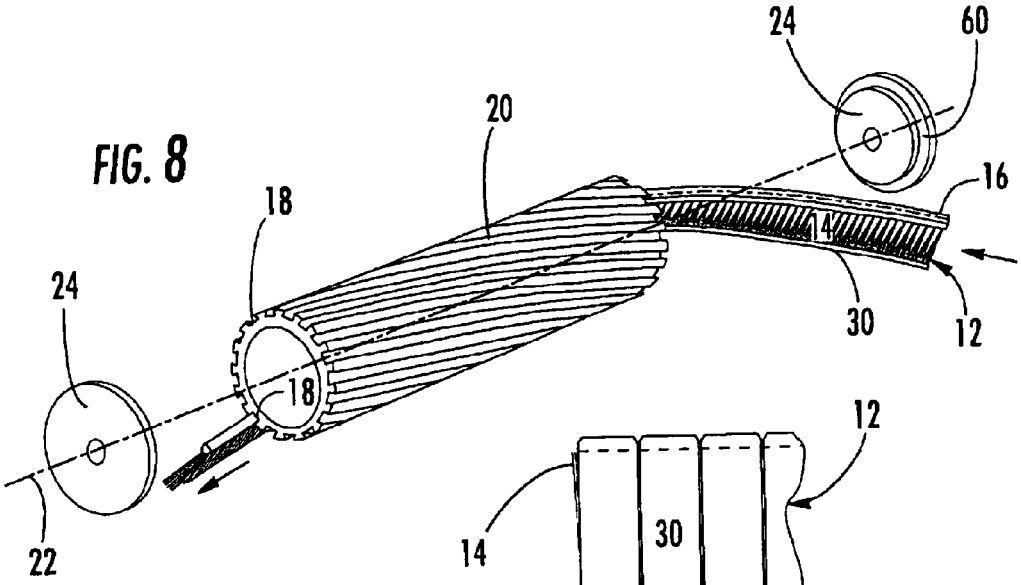
FIG. 8 shows a perspective view of a core with spirally-formed, dove-tail shaped grooves according to the invention.

FIG. 8 shows a cylindrical core 20 with dove-tailed grooves 18 in the external periphery 26 of the core. As indicated, the grooves 18 are formed in a helical or spiral manner, so that by movement along a groove in the longitudinal direction of the core from the one end to the other, the center of the grooves are mutually, rotationally displaced. The figure also shows a sanding strip 12 being introduced from the one end of the core 20, while at the same time the used sanding strip 12 in the same dove-tailed groove is being displaced out of the opposite end of the core.

Figure 9:
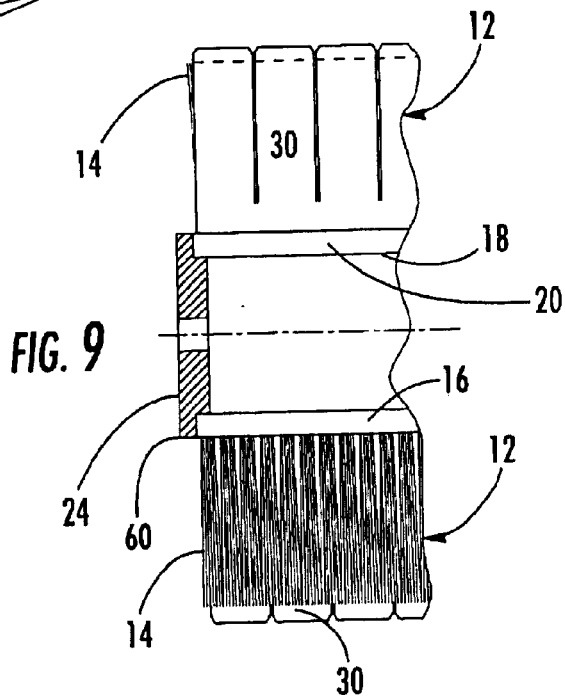
FIG. 9 shows a detail side-section view of a sanding wheel with end cover mounted.

In FIG. 9 it is shown how an annular edge 60 on the end cover 24 of the core blocks the ends of the dove-tailed grooves 18, so that the dove-tailed rails 16 with sanding strips 12 are secured in the grooves 18 between the covers.

Figure 10:
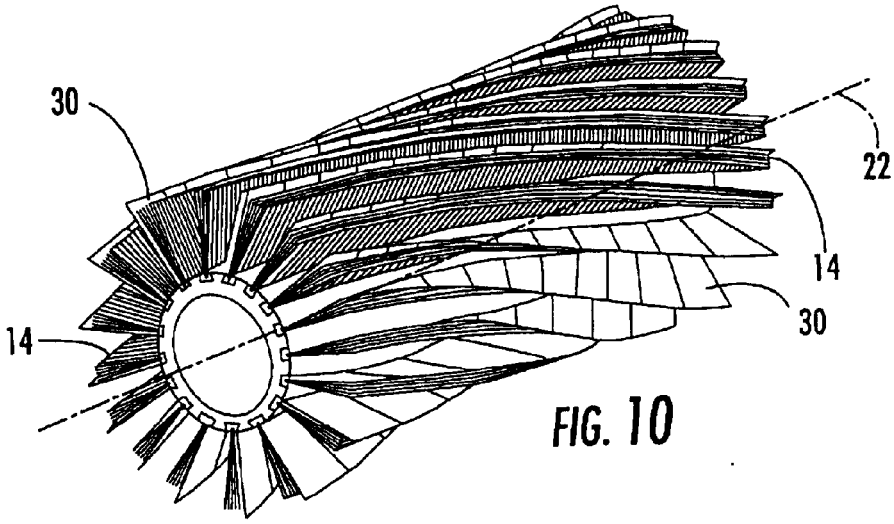
FIG. 10 shows a perspective view of a sanding brush with sanding strip placed on the core in a spirally-extending manner according to the invention.

FIG. 10 shows a finished sanding wheel/roller where the core 20 is fully mounted with sanding strips 12 according to the invention. The inclined position of the sanding strips 12 makes it possible for the sanding rollers/brushes to be mounted in a sanding machine at right-angles to the transport direction of the items, in that due to the inclined position of the sanding strips in relation to the transport direction of the items, the sanding of an item which is fed under and in contact with the sanding strips 12 will result in a chamfering (slight rounding-off) of the edges of the sanded item, which with the use of the known sanding wheels would otherwise be effected only when the roller is mounted in an inclined position in relation to the transport direction of the item.

Figure 11:
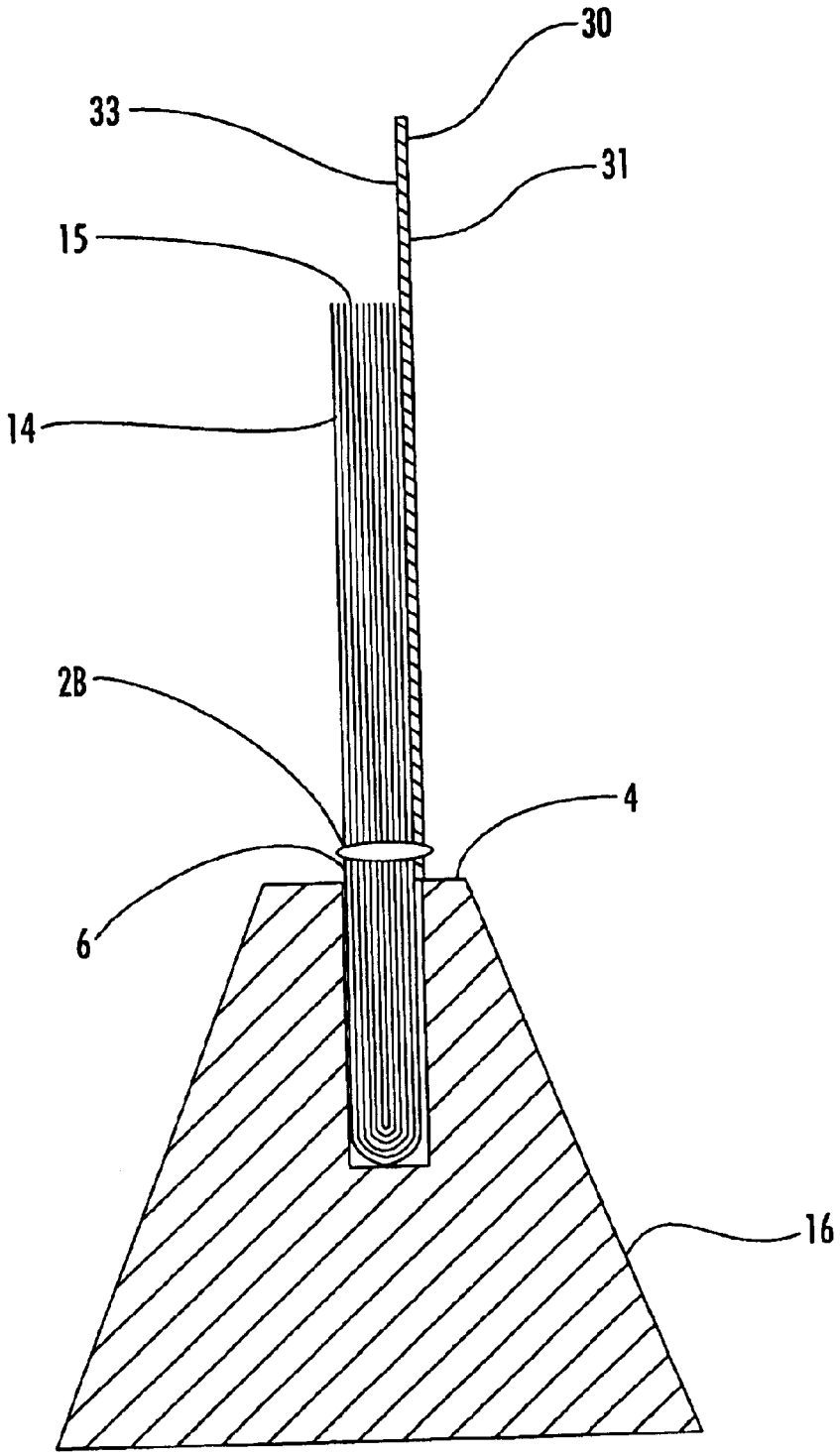
FIG. 11 shows the section of FIG. 6 in another embodiment of the invention.

FIG. 11 shows a cross-sectional view, similar to that of FIG. 6, wherein the sanding means 30 is shown affixed to the bunch 15 of brush hairs 14 in another embodiment of the invention. Specifically, the sanding means 30 is fastened directly on the brushes 14 by sewing with a relevant thread 2B in an area in an immediate vicinity of the narrowest edge 4 of the profiled edge rail 16. Preferably, the sewing thread 2B passes around the respective brush bunch 15 in the profiled edge rail 16. The thread 2B may be sewn around the entire bunch 15 of brush hairs 14 in order to firmly secure the sanding means 30 to the bunch. Alternatively, of course, the thread 2B may be woven through the bunch 15 so as to wrap around individual hairs 14 or clumps of individual hairs to thus secure the sanding means 30 to the bunch 15. These and other sewing/weaving techniques known in the sewing arts are contemplated by the invention in order to secure the sanding means 30 to the bunches 15 in the present embodiment.

With the invention there is thus provided a sanding strip 12 which is able to be manufactured in a considerably easier manner than the known sanding strips, where the sanding means is secured directly to the bracing elements/the brushes, so that the sanding strip retains deflection characteristics which are sufficient to make it possible, with the use of an assembly technique with undercut grooves (dove-tail assembly), which in itself is known, to produce sanding wheels with radially-protruding sanding strips which extend in a spiral manner, which means that the construction of sanding machines can take place without the machine's driving shafts having to be suspended in an inclined manner, which is expensive. Moreover, the individual sanding strips can be replaced as required, all depending on the degree to which these are worn.

It must be mentioned that the invention is particularly suitable especially in connection with older sanding machines with the normal, inclined shafts, where by using the sanding strips and sanding wheels/rollers according to the invention it is now possible to carry out the sanding of items and at the same time effect a chamfering of the edges of the items.

What is claimed is:

1. A sanding strip for use with a sanding wheel mounted on a rotatable shaft, comprising:

a sanding means comprising a front and a back; and a flexible, profiled edge rail comprising radially-protruding line-formed brushes, at least one side surface of the profiled edge rail supporting the back of the sanding means, wherein free ends of the sanding means extend outside free ends of the brushes, the brushes being formed of hairs arranged and secured in a longitudinal direction of the profiled edge rail from which the brushes extend from a narrowest side;

wherein the sanding means is fastened to the brushes by a securing means, the back side being directly on at least one side of an in-line row of brushes outside the profiled edge rail, so that the side of the sanding means facing towards the profiled edge rail is substantially in contact with an upper edge of the narrowest side of the profiled edge rail.

2. The sanding strip according to claim 1, wherein the brush hairs are arranged and secured in bunches so that along the longitudinal direction of the profiled edge rail a space is formed between each of the brush hair bunches, and wherein the securing means for fastening the sanding means to the sides of the brushes comprises glue extruded respectively on the side of the brushes facing towards the back of the sanding means, and in the spaces between each of the brush hair bunches.

3. The sanding strip according to claim 2, wherein the glue for fastening the sanding means to the sides of the brushes comprises hot-melt glue.

4. The sanding strip according to claim 2, wherein the sanding means are fastened directly on the brushes by sewing with a relevant thread in an area in an immediate vicinity of the narrowest side of the profiled edge rail, so that the sewing thread passes around each of the brush bunches in the profiled edge rail.

5. The sanding strip according to claim 1, wherein the profiled edge rail comprises a flexible plastic material.

6. The sanding strip according to claim 5, wherein the flexible plastic material comprises polyethylene (PE).

7. The sanding strip according to claim 1, wherein the profiles edge rail has a dove-tailed cross-section for co-operating with a corresponding undercut groove in a cylindrical core of the sanding wheel.

8. The sanding strip according to claim 1, wherein the sanding strip comprises a rolled-up web sanding strip.

9. A sanding wheel for mounting on a rotatable shaft, comprising:

a substantially cylindrical core having undercut grooves at peripheral areas in which sanding strips are anchored by profiled edge rails co-operating with the sanding wheel;

wherein the sanding strips are inserted in said grooves, and wherein the sanding strips comprise:

a sanding means comprising a front and a back; and a flexible, profiled edge rail comprising radially-protruding line-formed brushes, at least one side surface of the profiled edge rail supporting the back of the sanding means, wherein free ends of the sanding means extend outside free ends of the brushes, the brushes being formed of hairs arranged and secured in a longitudinal direction of the profiled edge rail from which the brushes extend from a narrowest side; wherein the sanding means is fastened to the brushes by a securing means, the back side being directly on at least one side of an in-line row of brushes outside the profiled edge rail, so that the side of the sanding means facing towards the profiled edge rail is substantially in contact with an upper edge of the narrowest side of the profiled edge rail.

10. The sanding wheel according to claim 9, wherein the undercut grooves extend in a helical manner in relation to a centre axis of the core.

* * * * *